US010073371B2

(12) United States Patent
Matsuura et al.

(10) Patent No.: US 10,073,371 B2
(45) Date of Patent: Sep. 11, 2018

(54) IMAGE FORMING APPARATUS AND IMAGE FORMING METHOD

(71) Applicants: Yuugo Matsuura, Kanagawa (JP); Kohei Matsumoto, Kanagawa (JP)

(72) Inventors: Yuugo Matsuura, Kanagawa (JP); Kohei Matsumoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/656,027

(22) Filed: Jul. 21, 2017

(65) Prior Publication Data

US 2018/0059569 A1 Mar. 1, 2018

(30) Foreign Application Priority Data

Aug. 24, 2016 (JP) ..... 2016-163494

(51) Int. Cl.
*G03G 15/043* (2006.01)
*G03G 15/00* (2006.01)

(52) U.S. Cl.
CPC ..... *G03G 15/043* (2013.01); *G03G 15/5041* (2013.01)

(58) Field of Classification Search
CPC ..... G03G 15/043
See application file for complete search history.

(56) References Cited

U.S. PATENT DOCUMENTS

2011/0228355 A1* 9/2011 Morita ..... G03G 15/043 358/475
2013/0243459 A1* 9/2013 Omori ..... G03G 15/5058 399/49
2016/0026109 A1 1/2016 Nakayama et al.
2016/0147174 A1 5/2016 Yasuda et al.
2016/0275381 A1 9/2016 Maeda et al.
2016/0291507 A1 10/2016 Nakayama et al.

FOREIGN PATENT DOCUMENTS

JP 2014-132318 7/2014

* cited by examiner

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

An image forming apparatus includes a photoconductor, a light source, an optical scanning device, an image bearer, an image density sensor, an image processing circuit, and a light source driver. The plurality of images are formed with a plurality of light intensities and a plurality of image area rates on the image bearer. The image density sensor detects a plurality of image densities of the plurality of images at a plurality of positions in a main scanning direction. The image processing circuit determines a light intensity correction value to correct an image density of a target image in the main scanning direction based on the plurality of light intensities, image area rates, image densities, and positions, and the image area rate of the target image, and outputs a control signal to adjust a light intensity. The light source driver adjusts the light intensity based on the control signal.

9 Claims, 11 Drawing Sheets

| IMAGE AREA RATE (%) | POSITION A | POSITION B | POSITION C |
|---|---|---|---|
| 80 | 118 | 100 | 120 |
| 40 | 114 | 100 | 118 |

FIG. 5

| IMAGE AREA RATE (%) | 90% OF STANDARD LIGHT INTENSITY | STANDARD LIGHT INTENSITY | 110% OF STANDARD LIGHT INTENSITY |
|---|---|---|---|
| 80 | 90 | 100 | 110 |
| 40 | 95 | 100 | 105 |

FIG. 6

| IMAGE AREA RATE (%) | POSITION A | POSITION B | POSITION C |
|---|---|---|---|
| 80 | −18 | 0 | −20 |
| 40 | −28 | 0 | −36 |

IMAGE FORMING APPARATUS AND IMAGE FORMING METHOD

CROSS-REFERENCE TO RELATED APPLICATION

This patent application is based on and claims priority pursuant to 35 U.S.C. § 119 to Japanese Patent Application No. 2016-163494, filed on Aug. 24, 2016 in the Japanese Patent Office, the entire disclosure of which is hereby incorporated by reference herein.

BACKGROUND

Technical Field

Exemplary aspects of the present disclosure generally relate to an image forming apparatus, such as a copier, a facsimile machine, a printer, a scanner, or a multifunction peripheral including a combination thereof, and an image forming method implemented with the image forming apparatus.

Background Art

Known image forming apparatuses output an image density control pattern on a sheet or an intermediate transfer belt, where a sensor reads and detects image density distribution of the pattern in a main scanning direction, and execute feedback control of a light source based on the detected image density distribution. In such an image forming apparatus, an image area rate of the image density control pattern is less than or equal to that of half tone. Such an image forming apparatus minimizes the image density distribution of half tone and highlight that tend to be a wide image density distribution and easily noticeable.

However, the image density distribution in the main scanning direction of half tone and highlight varies in accordance with the image area rate. Therefore, the image forming apparatus described above does not fully minimize the image density distribution of halftone and highlight whose image area rate is different from the one of the image density control pattern.

SUMMARY

This specification describes an improved image forming apparatus. In one illustrative embodiment, the image forming apparatus includes a photoconductor, a light source to emit a light beam onto the photoconductor, an optical scanning device to scan the photoconductor with the light beam, an image bearer, an image density sensor, an image processing circuit, and a light source driver. The plurality of images are formed with a plurality of light intensities of the light source and a plurality of image area rates, respectively, transferred from the photoconductor to the image bearer. The image density sensor detects a plurality of image densities of the plurality of images at a plurality of positions on the image bearer or on the photoconductor, respectively, in a main scanning direction of the light beam. The image processing circuit calculates an image area rate of a target image to be formed based on inputted image data, determines a light intensity correction value to correct an image density of the target image in the main scanning direction based on the plurality of light intensities of the plurality of images, the plurality of image area rates of the plurality of images, the plurality of image densities detected by the image density sensor, the plurality positions at which the image density sensor detects the plurality of image densities, and the image area rate of the target image, and outputs a control signal to adjust a light intensity. The light source driver adjusts the light intensity of the light beam emitted by the light source based on the control signal output by the image processing circuit.

This specification further describes an improved image forming method for forming an electrophotographic image with an image forming apparatus. In one illustrative embodiment, the image forming method includes forming a plurality of patterns with a plurality of image area rates and a plurality of light intensities, detecting a plurality of image densities of the plurality of the patterns at different positions in a main scanning direction, storing a relation between the plurality of image area rates, the plurality of light intensities, and the plurality of detected image densities of the plurality of the patterns at the different positions in the main scanning direction, calculating an image area rate in an output image at a position in the main scanning direction from image data of the output image, and adjusting a light intensity for the output image based on the calculated image area rate of the output image, the position in the main scanning direction, and the stored relation.

This specification still further describes an improved image forming apparatus. In one illustrative embodiment, the image forming apparatus includes a light emitting means for emitting a light beam, an optical scanning means for scanning with the light beam, an image bearing means, an image density detecting means, an image processing means, and a light intensity adjusting means. The image bearing means bears a plurality of images formed with a plurality of light intensities of the light emitting means and a plurality of image area rates, respectively. The plurality of images are transferred from the photoconductor to the image bearing means. The image density detecting means detects a plurality of image densities of the plurality of images at a plurality of positions on at least one of the image bearing means and the photoconductor, respectively, in a main scanning direction of the light beam. The image processing means calculates an image area rate of a target image to be formed based on inputted image data, determines a light intensity correction value to correct an image density of the target image in the main scanning direction based on the plurality of light intensities of the plurality of images, the plurality of image area rates of the plurality of images, the plurality of image densities detected by the image density detecting means, the plurality positions at which the image density detecting means detects the plurality of image densities, and the image area rate of the target image, and outputs a control signal to adjust a light intensity of the light beam emitted by the light emitting means. The light intensity adjusting means adjusts the light intensity of the light beam emitted by the light emitting means based on the control signal output by the image processing means.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 5 is a chart illustrating an example of a relation between light intensity and image densities of patterns with different image area rates;

FIG. 6 is a chart illustrating an example of light intensity correction values;

DETAILED DESCRIPTION

Figure 1:
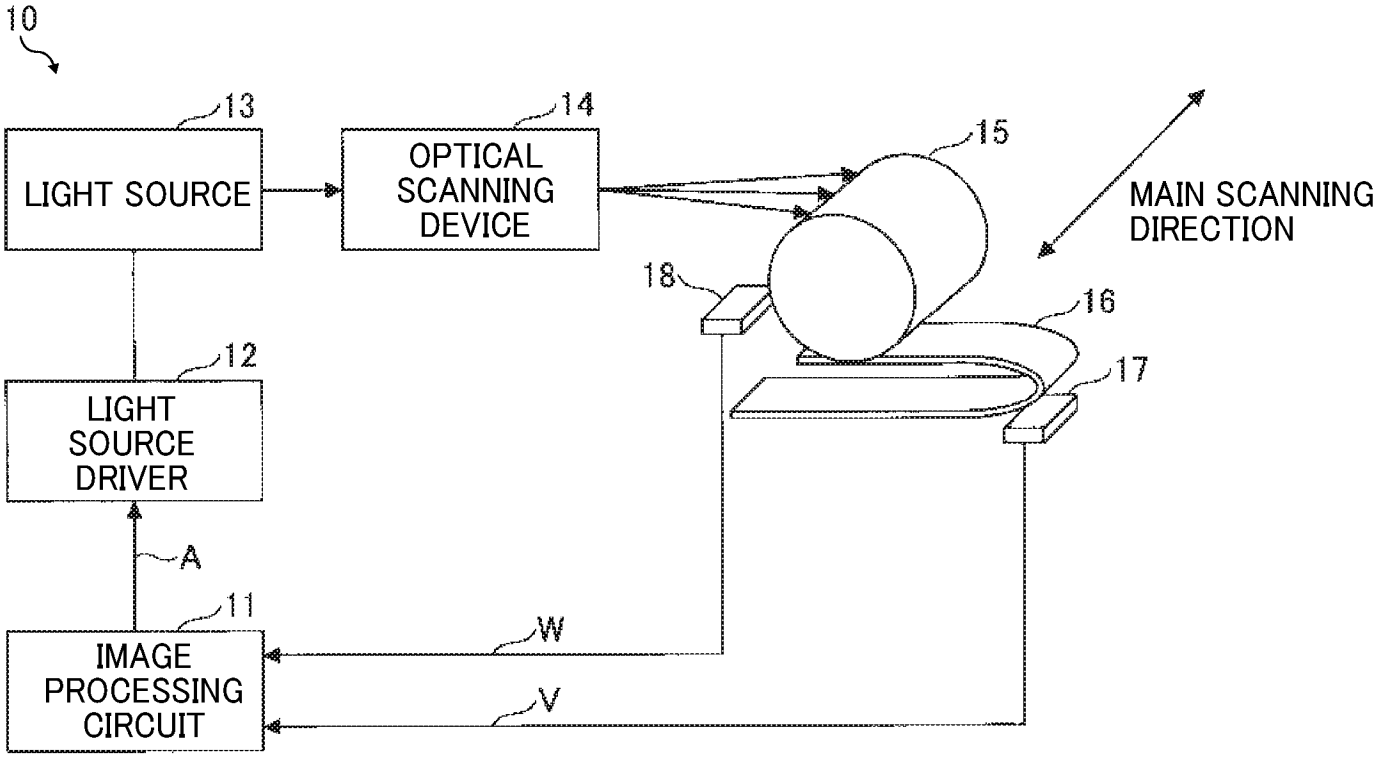
FIG. 1 schematically illustrates an image forming apparatus according to an embodiment of the present disclosure.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 10 according to an embodiment is explained.

An embodiment of the present disclosure is described below referring to accompanying drawings. In this description and the following drawings, a substantially same structure is given a same reference numeral. A redundant description thereof is omitted.

Figure 2:
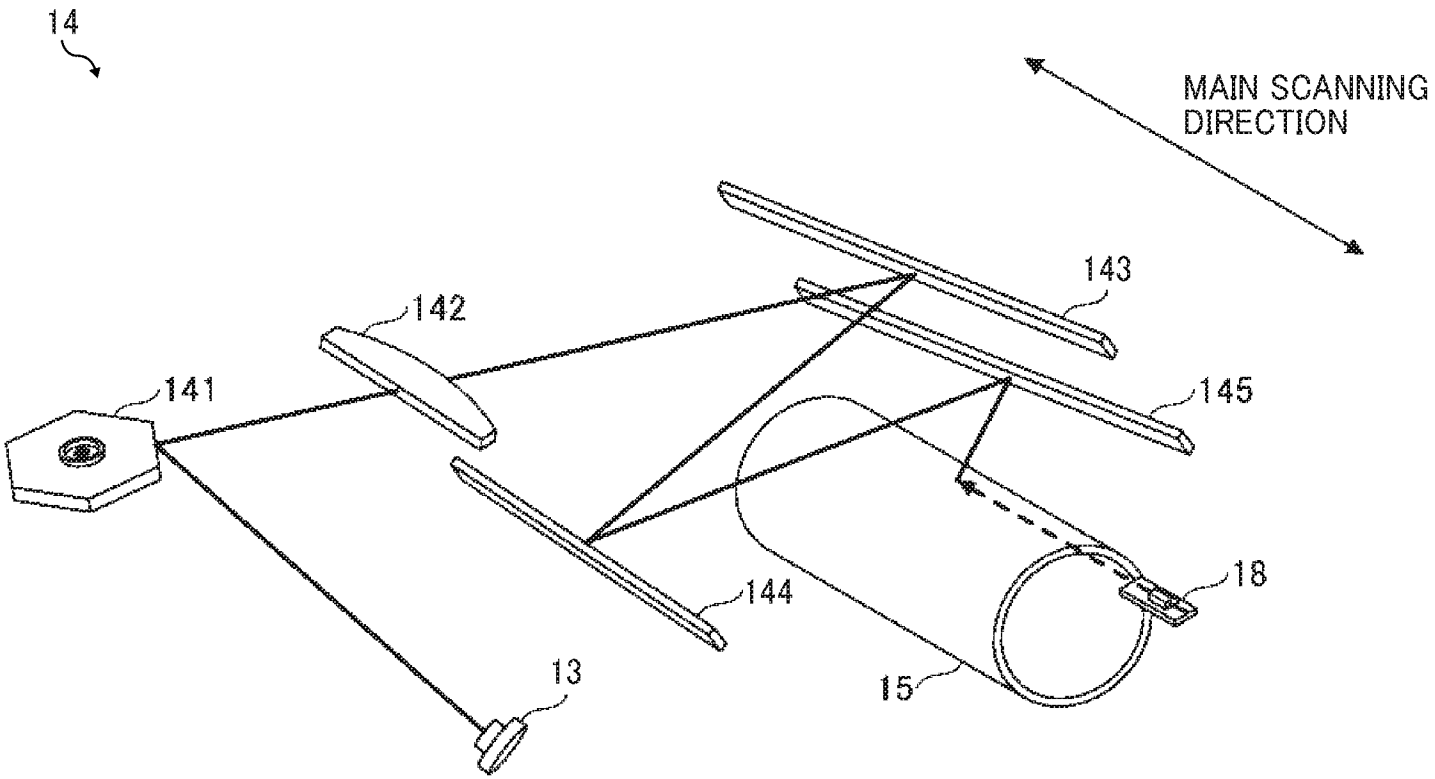
FIG. 2 schematically illustrates an optical scanning device used in the image forming apparatus illustrated in FIG. 1.

Referring to FIGS. 1 and 2, the image forming apparatus 10 according to an embodiment is described below.

FIG. 1 is a schematic diagram illustrating the image forming apparatus 10 according to the embodiment. FIG. 2 is an explanatory diagram illustrating an optical scanning device 14 illustrated in FIG. 1. In FIGS. 1 and 2, an arrow indicates a main scanning direction.

As illustrated in FIG. 1, the image forming apparatus 10 includes an image processing circuit 11, a light source driver 12, a light source 13, the optical scanning device 14, a photoconductor 15, an intermediate transfer belt 16 serving as an image bearer, an image density sensor 17, and a synchronization sensor 18.

The image processing circuit 11 includes, for example, a central processing unit (CPU), a read only memory (ROM), a random access memory (RAM), and a memory. The CPU reads out a program stored in the ROM and the like to the memory, executes the program, and makes possible to realize each of functions of the image processing circuit 11. Based on an image density signal V input from the image density sensor 17 and a synchronization signal W input from the synchronization sensor 18, the image processing circuit 11 detects an image density, calculates a light intensity correction value to correct the image density in the main scanning direction, and generates and outputs a control signal A to control the light intensity to the light source driver 12 to adjust the intensity of light emitted by the light source 13.

The light source driver 12 has a function to adjust the intensity of the light source 13 based on the control signal A.

The light source 13 is a device that emits a light beam and may, for example, be a semiconductor laser. An example of the semiconductor laser is a Vertical Cavity Surface Emitting Laser (VCSEL).

As illustrated in FIG. 2, the optical scanning device 14 includes a polygon mirror 141, an f-θ lens 142, and reflective mirrors 143, 144, and 145. The polygon mirror 141 deflects the light beam emitted from the light source 13 so that the light beam scans the photoconductor 15 in the main scanning direction. The f-θ lens 142 causes the light beam to scan the photoconductor 15 at a constant speed. The reflective mirrors 143, 144, and 145 reflect the light beam that passes through the f-θ lens 142. The reflected light beam irradiates the photoconductor 15. The optical scanning device 14 may not include the reflective mirrors 143, 144, and 145. In such a case, the light beam having passed through the f-θ lens 142 irradiates the photoconductor 15.

The light beam emitted from the light source 13 is focused on the photoconductor 15 via the optical scanning device 14 and forms an electrostatic latent image on an outer circumferential surface of the photoconductor 15. After the electrostatic latent image is formed, a developing process and a transfer process are executed. As a result, toner whose amount corresponds to the light intensity and an exposure time of the light source 13 is adhered to the intermediate transfer belt 16 and forms a desired image (e.g., a toner image). The intermediate transfer belt 16 is located in contact with the photoconductor 15 and is an endless belt on which the image corresponding to the electrostatic latent image is formed.

The image density sensor 17 detects an image density of a toner pattern formed on the intermediate transfer belt 16, converts a toner adhesion amount of the toner pattern into a voltage, and outputs to the image processing circuit 11 an image density signal V as an output signal that is the converted voltage. The image density sensor 17 may, for example, include a light-emitting diode whose emitting light is emitted toward the intermediate transfer belt 16 and a light receiving element that detects a regular reflection light and a diffuse reflection light corresponding to the toner adhesion amount on the intermediate transfer belt 16. The image density sensor 17 may be a line sensor that is used for a scanner.

The synchronization sensor 18 is a photoelectric conversion element that detects the light beam. The light beam reflected from the mirror located on a scanning path of the light beam enters the synchronization sensor 18 at a specified timing. The synchronization sensor 18 generates a voltage from an incident light as a synchronization signal W and outputs the synchronization signal W to the image processing circuit 11.

Figures 3, 4:
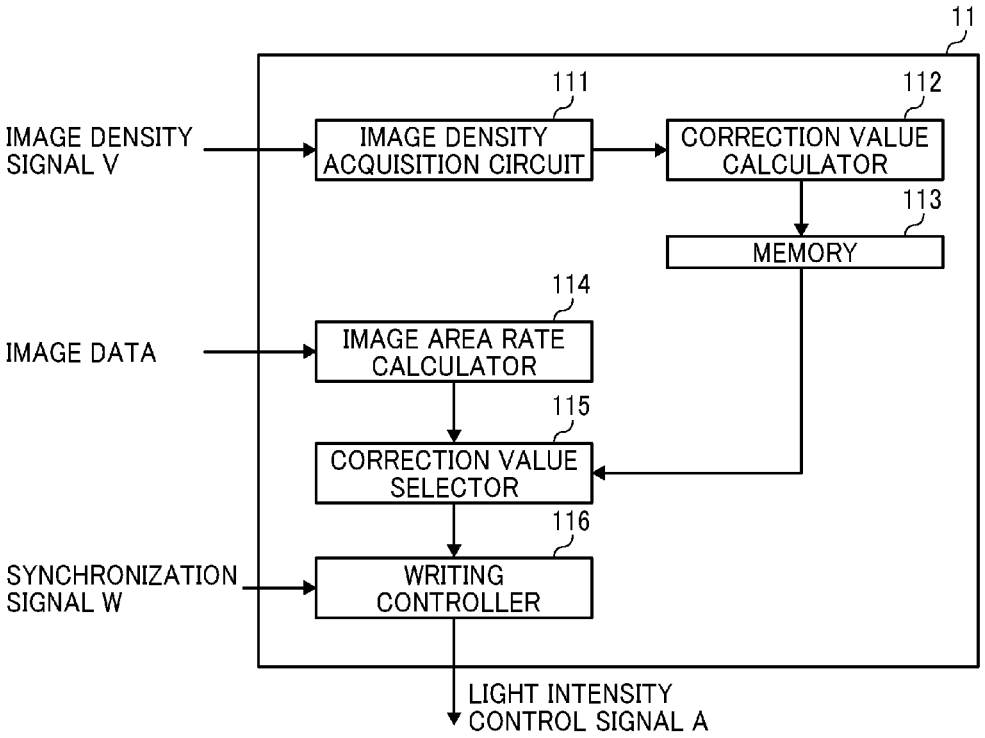
FIG. 3 schematically illustrates an image processing circuit of the image forming apparatus illustrated in FIG. 1.
FIG. 4 is a chart illustrating an example of a relation between a position in a main scanning direction and image densities of patterns with different image area rates.

Referring to FIG. 3, a description is given below of an example of a structure and a function of the image processing circuit 11. FIG. 3 is an explanatory diagram to describe the image processing circuit in FIG. 1.

As illustrated in FIG. 3, the image processing circuit 11 includes an image density acquisition circuit 111, a correction value calculator 112, a memory 113, an image area rate calculator 114, a correction value selector 115, and a writing controller 116.

The image density acquisition circuit 111 acquires each of image density signals V from image density sensors 17*a*, 17*b*, and 17*c* (illustrated in FIG. 7) provided corresponding to a pattern for controlling an image density (hereinafter referred to as an image density control pattern).

The correction value calculator 112 calculates the light intensity correction value for a specified image area rate and a specified position in the main scanning direction based on a relation between a position in the main scanning direction and an image density and a relation between a light intensity of the light source 13 and an image density. The correction value calculator 112 then calculates the light intensity correction value needed to decrease image density distribution in the main scanning direction.

The relation between the position in the main scanning direction and the image density may be, for example, expressed in the form of a chart illustrated in FIG. 4. FIG. 4 illustrates image density ratios of the image density control patterns in each of image area rates at different positions a, b, and c in the main scanning direction. For example, FIG. 4 illustrates image density ratios of the image density control patterns whose image area rates are 40% and 80% at the positions a, b, and c. As illustrated in FIG. 4, when the image density ratio of the pattern whose image area rate is 80% is a standard image density ratio (100) at the position b, the image density ratio at the position a is 118 and the image density ratio at the position c is 120. Similarly, as illustrated in FIG. 4, when the image density ratio of the pattern whose image area rate is 40% is the standard image density ratio (100) at the position b, the image density ratio at the position a is 114 and the image density ratio at the position c is 118. Above example in FIG. 4 sets the image density at the position b as the standard image density ratio (100). However, an image density at another position, for example, the image density at the position a or the position c may be set as the standard image density ratio (100).

The relation between light intensity of the light source 13 and the image density may be, for example, expressed in the form of a chart illustrated in FIG. 5. FIG. 5 illustrates image density ratios of the image density control patterns in each of image area rates when the light intensity of the light source 13 is set 90% of a standard light intensity, the standard light intensity, and 110% of the standard light intensity. For example, FIG. 5 illustrates image density ratios of the image density control patterns whose image area rates are 40% and 80% when the light intensity of the light source 13 is set 90% of a standard light intensity, the standard light intensity, and 110% of the standard light intensity. In FIG. 5, when the image area rate is 80% and the light intensity is the standard light intensity, the image density ratio of the image density control pattern is assumed to be 100. Then, as illustrated in FIG. 5, the image density ratio corresponding to 90% of the standard light intensity becomes 90, and the image density ratio corresponding to 110% of the standard light intensity becomes 110. That is, in a case in which the image area rate is 80%, when the light intensity of the light source 13 increases by 10%, the image density ratio increases by 10%, and when the light intensity of the light source 13 decreases by 10%, the image density ratio decreases by 10%. Similarly, in FIG. 5, when the image area rate is 40% and the light intensity is the standard light intensity, the image density ratio of the image density control pattern is assumed 100. Then, as illustrated in FIG. 5, the image density ratio corresponding to 90% of the standard light intensity becomes 95, and the image density ratio corresponding to 110% of the standard light intensity becomes 105. That is, in a case in which the image area rate is 40%, when the light intensity of the light source 13 increases by 10%, the image density ratio increases by 5%, and when the light intensity of the light source 13 decreases by 10%, the image density ratio decreases by 5%. Above example in FIG. 5 sets the standard image density ratio (100) when the light intensity is the standard light intensity. However, when another light intensity, for example, 90% of the standard light intensity or 110% of the standard light intensity, is used, the image density ratio may be set the standard image density ratio (100).

The light intensity correction value is calculated based on the relation between the position in the main scanning direction and the image density and the relation between the light intensity of the light source 13 and the image density.

For example, in a case in which the image area rate is 80%, referring to FIG. 5, because ±10% change of the light intensity of the light source 13 causes ±10% change of the image density ratio, correcting the image density ratio (118) at the position a to the standard image density ratio (100) needs −18% change of the light intensity of the light source 13. Similarly, correcting the image density ratio (120) at the position c to the standard image density ratio (100) needs −20% change of the light intensity of the light source 13. The light intensity of the light source 13 at the position b does not need to be changed because the image density ratio at the position b is the standard image density ratio (100).

For example, in a case in which the image area rate is 40%, referring to FIG. 5, because ±10% change of the light intensity of the light source 13 causes ±5% change of the image density ratio, correcting the image density ratio (114) at the position a to the standard image density ratio (100) needs −28% change of the light intensity of the light source 13. Similarly, correcting the image density ratio (118) at the position c to the standard image density ratio (100) needs −36% change of the light intensity of the light source 13. The light intensity of the light source 13 at the position b does not need to be changed because the image density ratio at the position b is the standard image density ratio (100).

The light intensity correction value calculated as above may be, for example, expressed in the form of a chart illustrated in FIG. 6. FIG. 6 illustrates a relation between the light intensity correction values and a plurality of the positions in the main scanning direction in each of image area rates. For example, in a case in which the image area rate is 80%, FIG. 6 illustrates the light intensity correction values −18, 0, and −20 at the positions a, b, and c, respectively. For example, in a case in which the image area rate is 40%, FIG. 6 illustrates the light intensity correction values −28, 0, and −36 at the positions a, b, and c, respectively.

The memory 113 stores the light intensity correction value that the correction value calculator 112 calculates.

The image area rate calculator 114 calculates the image area rate based on inputted image data. The image data is, for example, image data for the next page, the next line, or the like, which is formed in the image forming apparatus 10. The image data may be, for example, image data sent from a scanner that reads a document or image data input from an external device such as a personal computer. The image area rate calculated from the image data of the next page may be calculated at each position whose x-coordinate means the position in the main scanning direction and whose y-coordinate means a position in a sub-scanning direction. The image area rate may be stored with the position. The image area rate calculated from the image data of the next line may be calculated at each position in the main scanning direction and stored with the position.

The correction value selector 115 selects the light intensity correction value corresponding to the image area rate based on the image area rate that the image area rate calculator 114 has calculated from the light intensity correction values stored with the image area rates in the memory 113. If the same image area rate is stored, the light intensity correction value corresponding to the same image area rate is selected. If the same image area rate is not stored, the light intensity correction value corresponding to the image area rate stored in the memory 113 closest to the image area rate that the image area rate calculator 114 has calculated is selected. The correction value selector 115 transmits the selected light intensity correction value to the writing controller 116.

Based on the light intensity correction value selected by the correction value selector 115 and the synchronization signal W generated by the synchronization sensor 18, the writing controller 116 generates the light intensity control signal A to control the light intensity of the light source 13 and transmits the light intensity control signal A to the light source driver 12.

Figure 7:
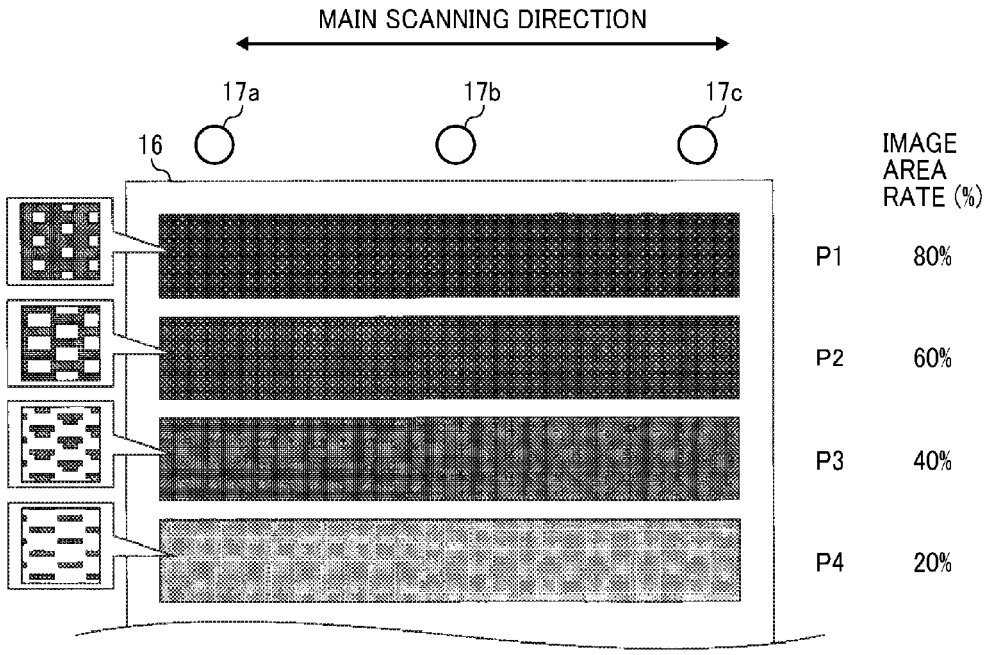
FIG. 7 is an explanatory diagram illustrating an example of an image density control pattern (1)

Referring to FIG. 7, a description is given of the image density control pattern formed by the image forming apparatus 10 according to the embodiment. FIG. 7 is an explanatory diagram illustrating an example of the image density control pattern.

As illustrated in FIG. 7, the image forming apparatus 10 forms the image density control pattern on the intermediate transfer belt 16 to detect the image densities. The image densities of the image density control pattern at specified positions on the intermediate transfer belt 16 in the main scanning direction may be detected by using the plurality of image density sensors 17*a*, 17*b*, and 17*c* provided along the main scanning direction. For example, FIG. 7 illustrates four types of image density control patterns P1, P2, P3, and P4 corresponding to four different image area rates, respectively. Each of the image density control patterns P1, P2, P3, and P4 is a rectangular pattern and is formed along the sub-scanning direction. The image area rate of the image density control pattern P1 is 80%. The image area rate of the image density control pattern P2 is 60%. The image area rate of the image density control pattern P3 is 40%. The image area rate of the image density control pattern P4 is 20%.

Figure 8:
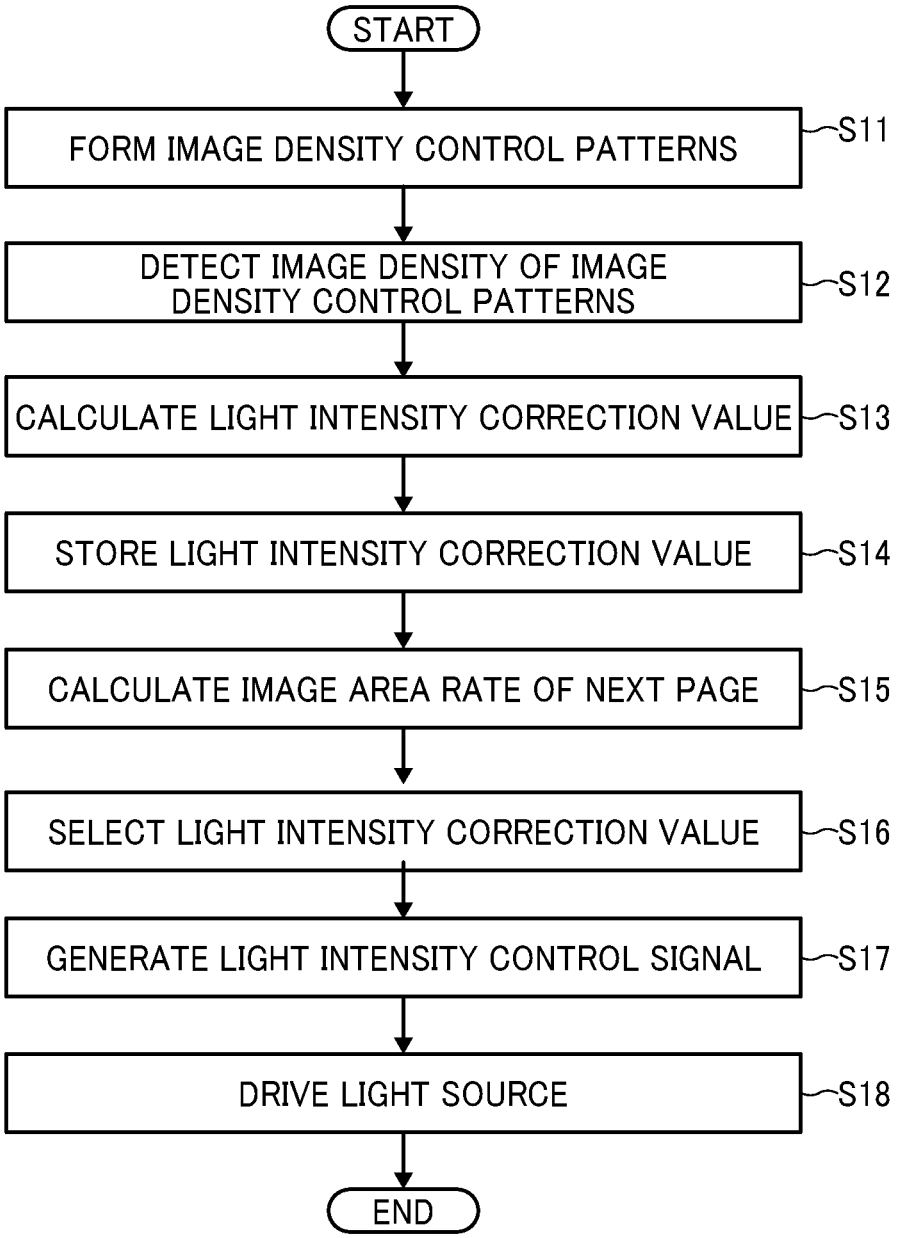
FIG. 8 is a flowchart illustrating an example of an image forming method according to the embodiment of the present disclosure.
Figure 9:
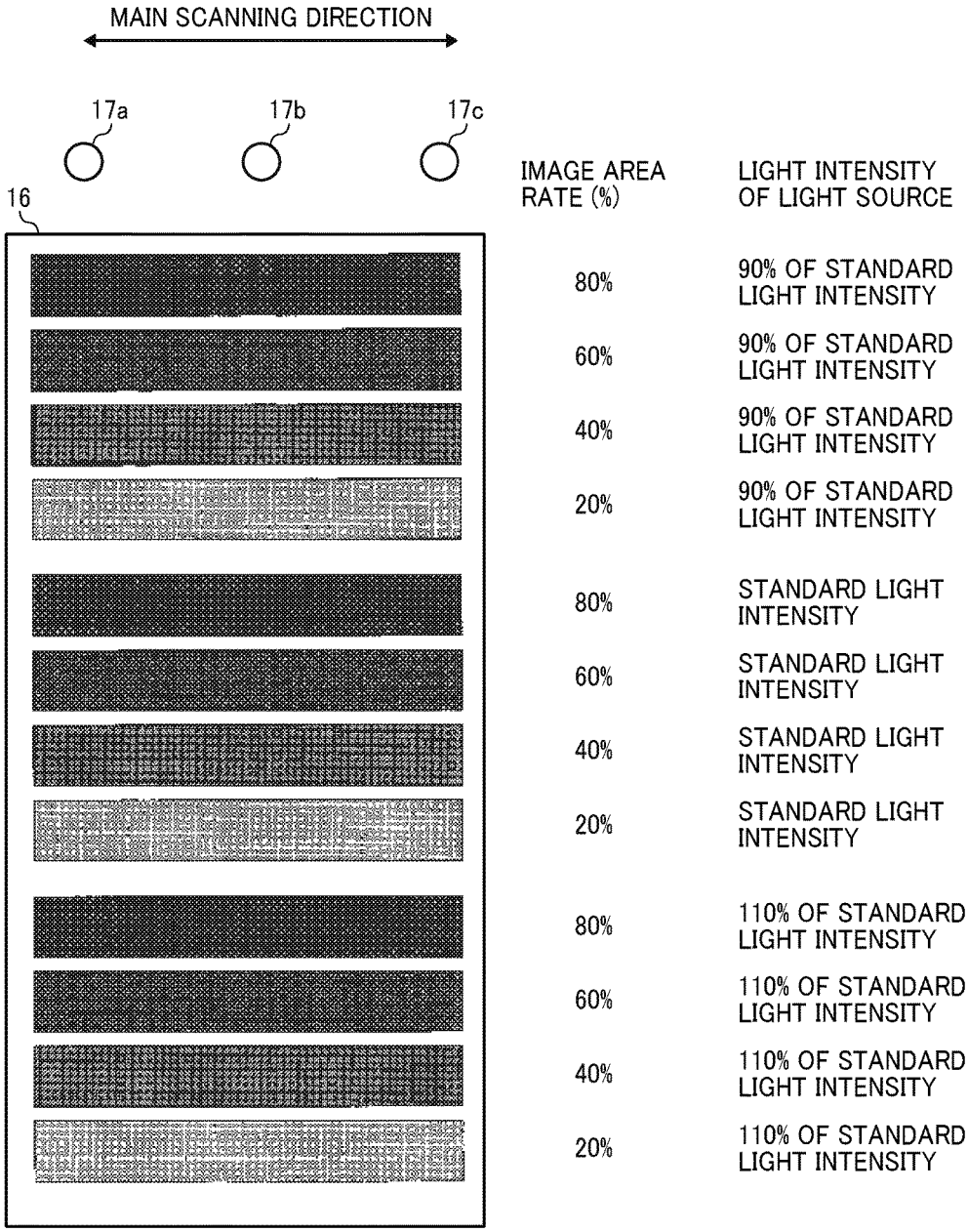
FIG. 9 is an explanatory diagram illustrating an example of an image density control pattern (2)

Referring to FIGS. 8 and 9, an example of an image forming method according to the embodiment is described below.

FIG. 8 is a flowchart illustrating an example of the image forming method according to the embodiment of the present disclosure. FIG. 9 is an explanatory diagram illustrating an example of the image density control pattern.

Firstly, the writing controller 116 controls the light source driver 12 and forms image density control patterns with a plurality of different image area rates and a plurality of different light intensities of the light source 13 at positions corresponding to the image density sensors 17*a*, 17*b*, and 17*c* provided above the intermediate transfer belt 16 (step S11). In this step, for example, as illustrated in FIG. 9, the writing controller 116 forms image density control patterns with image area rates 80%, 60%, 40%, and 20%. Each of the image density control patterns is formed with light intensities of 90% of the standard light intensity, the standard light intensity, and 110% of the standard light intensity of the light source 13.

Subsequently, the image density acquisition circuit 111 acquires each of image density signals V from the image density sensors 17*a*, 17*b*, and 17*c* corresponding to the image density control patterns (step S12).

Subsequently, the correction value calculator 112 calculates the light intensity correction value for a specified image area rate and a specified position in the main scanning direction based on the relation between the position in the main scanning direction and the image density and the relation between the light intensity of the light source 13 and the image density (step S13). In this step, the correction value calculator 112 calculates the light intensity correction value to decrease the image density distribution of each of the image area rates in the main scanning direction.

Subsequently, the memory 113 stores the light intensity correction value which the correction value calculator 112 has calculated in step S13 (step S14).

Subsequently, the image area rate calculator 114 calculates the image area rate of the next page based on the image data of the next page (step S15). When there are multiple half tone parts with different image area rates in the next page, the image area rate calculator 114 may calculate each image area rate of the half tone parts. The next page means a page of the image that the image forming apparatus 10 outputs after the memory 113 stores the light intensity correction value, that is, a target image to be formed based on the inputted image data.

Subsequently, the correction value selector 115 selects a suitable light intensity correction value from the light intensity correction values stored with the image area rates in the memory 113 in step S14 based on the image area rate which the image area rate calculator 114 has calculated in step S15 and transmits the selected light intensity correction value to the writing controller 116 (step S16). It is preferable that the suitable light intensity correction value corresponds to the image area rate that is the same as the image area rate calculated by the image area rate calculator 114 in step S15. If there is not the light intensity correction value with the image area rate that is the same as the image area rate calculated by the image area rate calculator 114 in step S15, it is preferable that the suitable light intensity correction value corresponds to the image area rate stored in the memory 113 closest to the image area rate which the image area rate calculator 114 has calculated in step S15.

Subsequently, based on the light intensity correction value selected by the correction value selector 115 and the synchronization signal W generated by the synchronization sensor 18, the writing controller 116 generates the light intensity control signal A to control the light intensity of the light source 13 and transmits the light intensity control signal A to the light source driver 12 (step S17).

Subsequently, the light source driver 12 drives the light source 13 based on the light intensity control signal A (step S18).

Thus, based on the inputted image data, the desired image is formed.

The image forming method according to the embodiment described above makes it possible to decrease the image density distribution in the main scanning direction for a plurality of images with various image area rates because the light intensity of the light source 13 is controlled by using different light intensity correction values for each of the image area rates.

Figure 10:
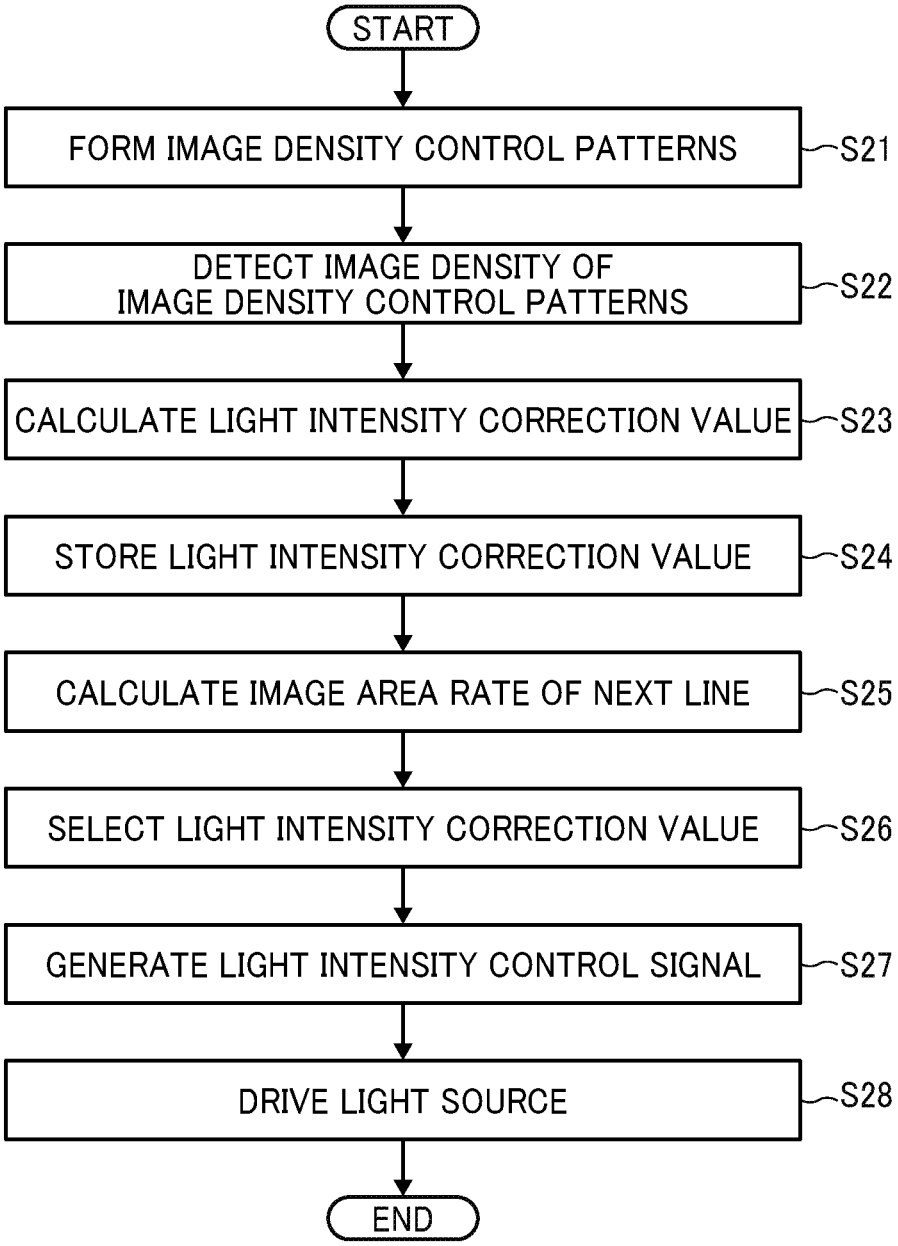
FIG. 10 is a flowchart illustrating another example of the image forming method according to the embodiment of the present disclosure.

With reference to FIG. 10, another example of the image forming method according to the embodiment is described below.

FIG. 10 is a flowchart illustrating another example of the image forming method according to the embodiment.

In the example in FIG. 10, the correction value selector 115 selects the suitable light intensity correction value based on the image area rate of the next line instead of the image area rate of the next page. Steps from S21 to S24, S27 and S28 are equal to steps from S11 to S14, S17, and S18 of the image forming method described hereinbefore.

The image area rate calculator 114 calculates the image area rate of the next line based on the image data of the next line in step S25.

In step S26, the correction value selector 115 selects the suitable light intensity correction value from the light intensity correction values stored with the image area rates in the memory 113 in step S24 based on the image area rate that the image area rate calculator 114 has calculated in step S25 and transmits the selected light intensity correction value to the writing controller 116.

In the example in FIG. 10, using the suitable light intensity correction value in each line makes it possible to control the light intensity of the light source 13 with a high degree of accuracy. As a result, the image density distribution in the main scanning direction becomes smaller than the example in FIG. 8.

In the image forming method described hereinbefore, the correction value selector 115 selects the light intensity correction value in each page or in each line. The correction value selector 115 may select the light intensity correction value in a plurality of pages or a plurality of lines. In such a case, it is preferable that the correction value selector 115 selects the light intensity correction value based on the image area rate whose image density distribution in the main scanning direction is the largest of all image density distribution in the main scanning direction corresponding to all image area rates of the plurality of pages or the plurality of lines.

Referring to FIGS. 11 to 15, a function and an effect are described below of the image forming apparatus 10 according to the embodiment.

Figure 11:
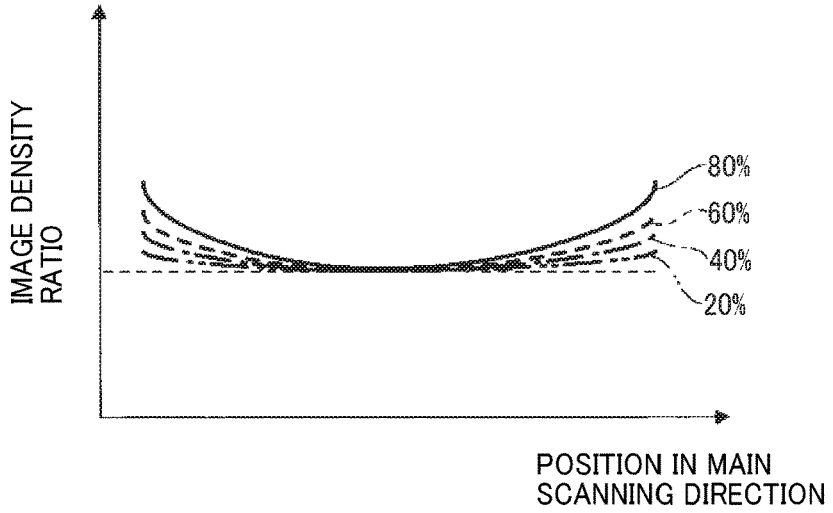
FIG. 11 is a graph illustrating an example of image density distribution in the main scanning direction.

Firstly, the image density distribution in the main scanning direction in different image area rates is described referring to FIG. 11. FIG. 11 is a graph illustrating the image density distribution in the main scanning direction. FIG. 11 illustrates the image density distributions of image density control patterns in the main scanning direction. Image area rates of the image density control patterns are 80%, 60%, 40%, and 200%. In FIG. 11, a horizontal axis represents positions in the main scanning direction and a vertical axis represents an image density ratio for an image density at a center position of the image density control pattern in the main scanning direction. A solid line in FIG. 11 means a characteristic curve for the image area rate 80%. A dashed line in FIG. 11 means a characteristic curve for the image area rate 60%. An alternate long and short dash line in FIG. 11 means a characteristic curve for the image area rate 40%. An alternate long and two short dashes line in FIG. 11 means a characteristic curve for the image area rate 20%.

As illustrated in FIG. 1, it can be seen that the image density distributions of the image density control patterns in the main scanning direction are different in the image area rates. Specifically, the greater the image area rate becomes, the wider the image density distribution in the main scanning direction becomes.

Figure 12:
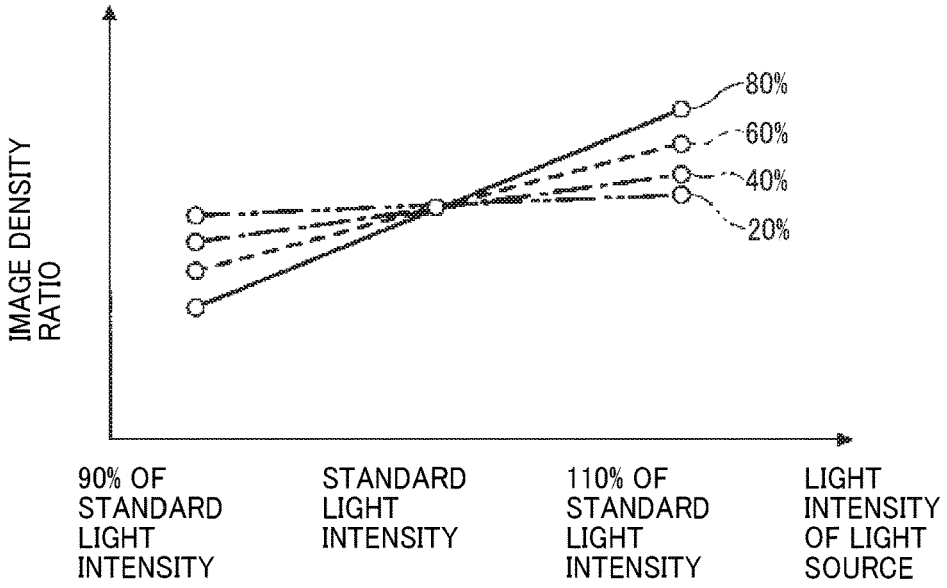
FIG. 12 is a graph illustrating an example of relations between the light intensity and image densities of patterns with different image area rates.

Next, with reference to FIG. 12, the relation between the light intensity of the light source 13 and the image density is described FIG. 12 is a graph illustrating relations between the light intensity of the light source 13 and the image densities in image area rates 80%, 60%, 40%, and 20% of the image density control patterns. In FIG. 12, the horizontal axis represents the light intensity of the light source 13 and the vertical axis represents an image density ratio for an image density at a center position of the image density control pattern in the main scanning direction. The solid line in FIG. 12 means a characteristic curve for the image area rate 80%. The dashed line in FIG. 12 means a characteristic curve for the image area rate 60%. The alternate long and short dash line in FIG. 12 means a characteristic curve for the image area rate 40%. The alternate long and two short dashes line in FIG. 12 means a characteristic curve for the image area rate 20%.

From FIG. 12 it can be seen that the relations between the light intensity of the light source 13 and the image density are different in the image area rates. Specifically, the greater the image area rate becomes, the greater an amount of change of the image density caused by the change of the light intensity of the light source 13 becomes.

In this embodiment, the light source driver 12 controls the light intensity of the light source 13 for an identified image area rate and an identified position in the main scanning direction based on the relation between the position in the main scanning direction and the image density and the relation between the light intensity of the light source 13 and the image density. Thus, even if an image including different image area rates is formed, the image density distribution in the main scanning direction may be made smaller than the one in an image forming apparatus that does not employ this embodiment.

Figure 13:
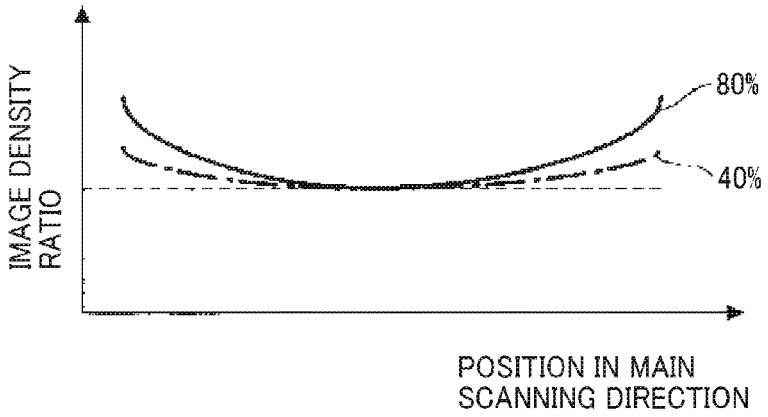
FIG. 13 is a graph illustrating the example of the image density distribution in the main scanning direction before execution of a light intensity control process by the image forming apparatus according to the embodiment of the present disclosure.
Figure 14:
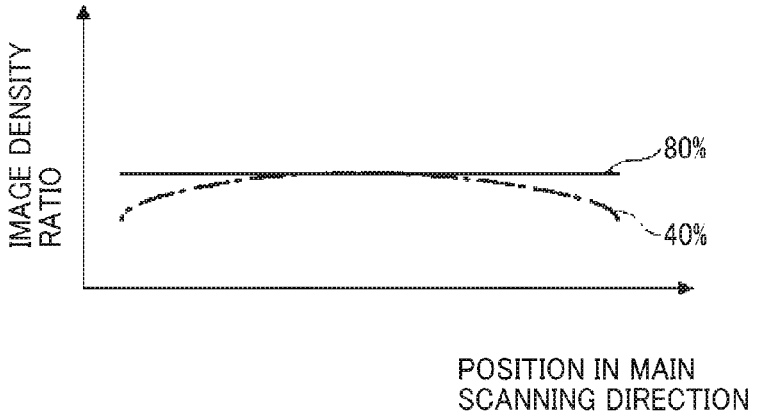
FIG. 14 is a graph illustrating an example of image density distributions in the main scanning direction after execution of the light intensity control process using a single correction value by the image forming apparatus.
Figure 15:
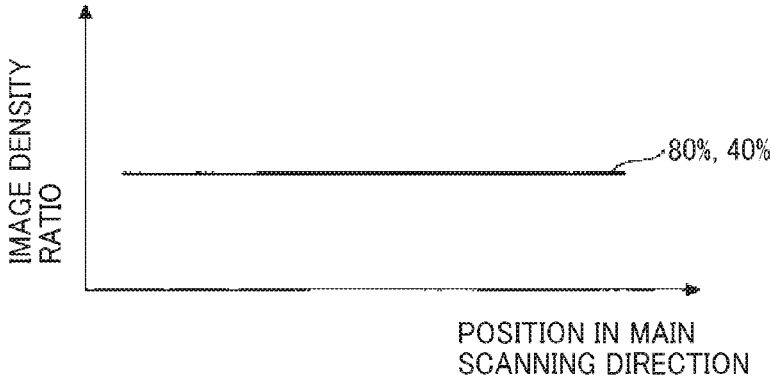
FIG. 15 is a graph illustrating an example of the image density distribution in the main scanning direction after the execution of the light intensity control process by the image forming apparatus according to the embodiment of the present disclosure.

FIG. 13 illustrates the image density distribution in the main scanning direction before controlling the light intensity of the light source 13. FIG. 14 illustrates the image density distribution in the main scanning direction after controlling the light intensity of the light source 13 by using a single light intensity correction value. FIG. 15 illustrates the image density distribution in the main scanning direction after controlling the light intensity of the light source 13 by using different light intensity correction values depending on image area rates. In FIGS. 13 to 15, the horizontal axis represents positions in the main scanning direction and the vertical axis represents an image density ratio for an image density at a center position of the image density control pattern in the main scanning direction. In FIGS. 13 to 15, the solid line means a characteristic curve for the image area rate 80% and the alternate long and short dash line means a characteristic curve for the image area rate 40%.

As illustrated in FIG. 13, there is a case in which the image density distributions of the image density control patterns in the main scanning direction are different between the image density distribution of the image area rate 80% and the image density distribution of the image area rate 40%. In this case, controlling of the light intensity of the light source 13 using a single light intensity correction value for different image area rates may not decrease the image density distributions of all image area rates. Specifically, as illustrated in FIG. 14, selection of the light intensity correction value that decreases the image density distribution of the image density control pattern of the image area rate 80% in the main scanning direction decreases the image density distribution of the image density control pattern of the image area rate 80% in the main scanning direction, but does not decrease the image density distribution of the image density control pattern of the image area rate 40% in the main scanning direction.

On the other hand, the image forming apparatus 10 according to the embodiment controls the light intensity of the light source 13 by using different light intensity correction values for each of the image area rates. Thus, as illustrated in FIG. 15, the image density distributions in the main scanning direction for a plurality of image having a plurality of different image area rates may be made smaller than the one in an image forming apparatus that does not employ this embodiment.

Figure 16:
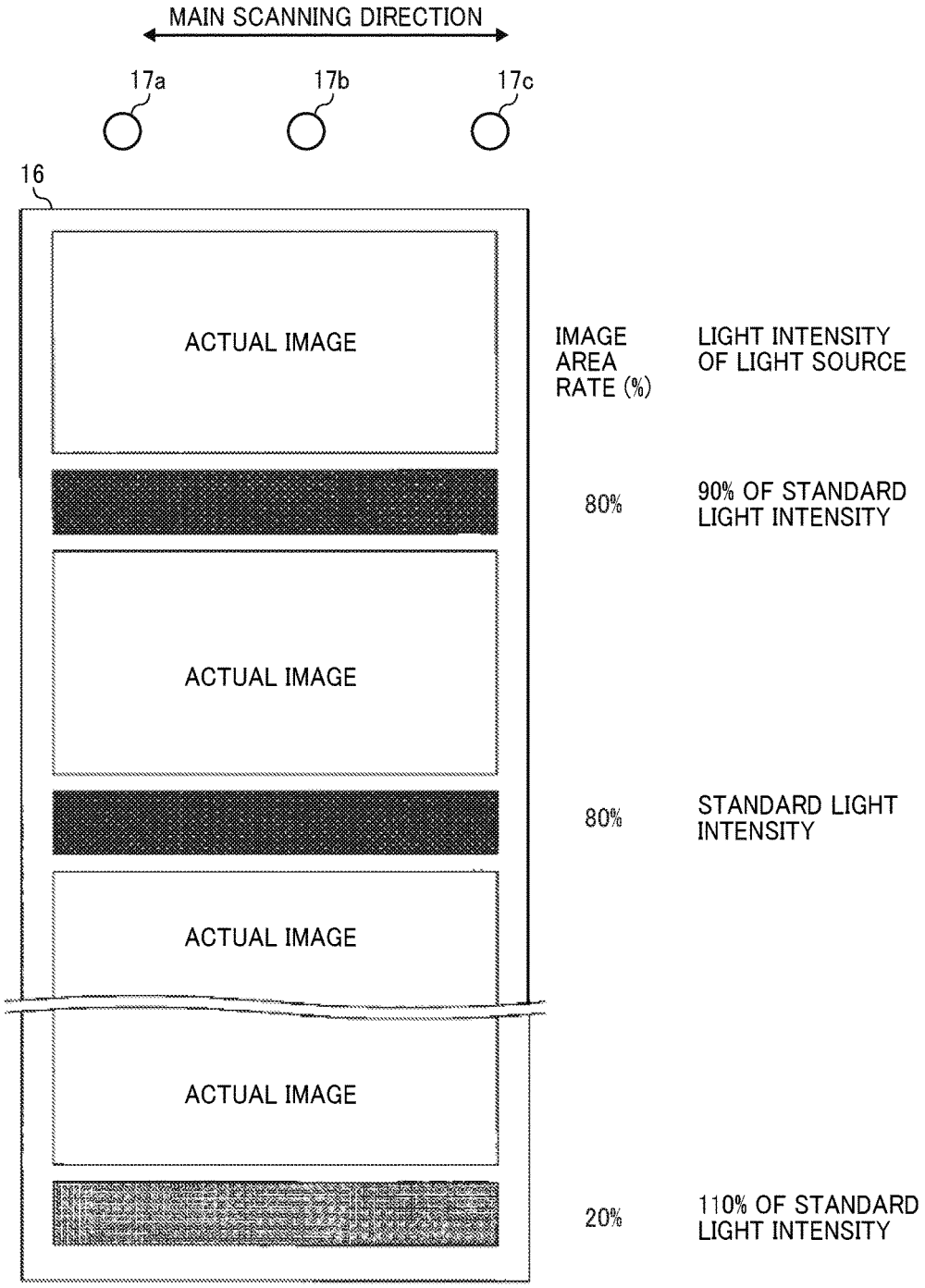
FIG. 16 is an explanatory diagram illustrating an example of timing for forming the image density control pattern.

Referring to FIG. 16, a description is given below of a timing that the image density control patterns are formed. FIG. 16 is an explanatory diagram illustrating an example of a timing for forming the image density control pattern.

The timing for forming the image density control pattern is not limited but preferably is a timing between pages of actual images as illustrated in FIG. 16. Setting timing like hereinbefore eliminates downtime to form the image density control patterns and makes it possible to correct a variation of image density caused by a variation of image forming condition such as a variation of temperature in real-time.

The present disclosure is not limited to the embodiment described above, and various modifications and improvements are possible within the scope of the present disclosure.

The above embodiment describes an example of a case in which the image densities of the image density control patterns formed on the intermediate transfer belt 16 are used. However, the present disclosure is not limited to this case. For example, the image forming apparatus 10 may form the image density control patterns on a sheet and use image densities of the image density control patterns formed on the sheet. The image density sensors 17 may be located to detect the image densities of the image density control patterns on the photoconductors 15.

The above embodiment describes an example of the case in which image densities are detected at three positions in the main scanning direction. However, the present disclosure is not limited to this case. For example, positions for detecting image densities in the main scanning direction may be two, four, or more. The above embodiment uses a table that represents relations between the positions in the main scanning direction, the image area rates, the light intensities, and the image densities. However, the image processing circuit may calculate an approximation formula from the relations and use the approximation formula for the control.

What is claimed is:

1. An image forming apparatus comprising:

a photoconductor;

a light source to emit a light beam onto the photoconductor;

an optical scanning device to scan the photoconductor with the light beam;

an image bearer to bear a plurality of images formed with a plurality of light intensities of the light source and a plurality of image area rates, respectively, transferred from the photoconductor;

an image density sensor to detect a plurality of image densities of the plurality of images at a plurality of positions on at least one of the image bearer and the photoconductor, respectively, in a main scanning direction of the light beam;

an image processing circuit to calculate an image area rate of a target image to be formed based on inputted image data, determine a light intensity correction value to correct an image density of the target image in the main scanning direction based on the plurality of light intensities of the plurality of images, the plurality of image area rates of the plurality of images, the plurality of image densities detected by the image density sensor, the plurality positions at which the image density sensor detects the plurality of image densities, and the image area rate of the target image, and output a control signal to adjust a light intensity of the light beam emitted by the light source; and a light source driver to adjust the light intensity of the light beam emitted by the light source based on the control signal output by the image processing circuit.

2. The image forming apparatus according to claim 1, wherein the image processing circuit calculates the image area rate in each page of the inputted image data, and the light source driver adjusts the light intensity of the light source in each page of the inputted image data.

3. The image forming apparatus according to claim 1, wherein the image processing circuit calculates the image area rate in each line of the inputted image data, and the light source driver adjusts the light intensity of the light source in each line of the inputted image data.

4. The image forming apparatus according to claim 1, wherein the image processing circuit calculates the image area rate in each page of the inputted image data, and the light source driver adjusts the light intensity of the light source based on the light intensity correction value determined by using the image area rate in which image density distribution in the main scanning direction is largest in the calculated image area rates of a plurality of pages of the inputted image data.

5. The image forming apparatus according to claim 1, wherein the image processing circuit calculates the image area rate in each line of the inputted image data, and the light source driver adjusts the light intensity of the light source based on the light intensity correction value determined by using the image area rate in which image density distribution in the main scanning direction is largest in the calculated image area rates of a plurality of lines of the inputted image data.

6. The image forming apparatus according to claim 1, wherein at least one of the plurality of images formed with the plurality of image area rates and the plurality of light intensities of the light source is formed between successive pages of the inputted image data.

7. The image forming apparatus according to claim 1, wherein the plurality of images are image density control patterns that correspond to different image area rates.

8. An image forming method for forming an electrophotographic image with an image forming apparatus, the image forming method comprising:

forming a plurality of patterns with a plurality of image area rates and a plurality of light intensities;

detecting a plurality of image densities of the plurality of the patterns at different positions in a main scanning direction;

storing a relation between the plurality of image area rates, the plurality of light intensities, and the plurality of detected image densities of the plurality of the patterns at the different positions in the main scanning direction;

calculating an image area rate in an output image at a position in the main scanning direction from image data of the output image; and adjusting a light intensity for the output image based on the calculated image area rate of the output image, the position in the main scanning direction, and the stored relation.

9. An image forming apparatus comprising:

a light emitting means for emitting a light beam;

an optical scanning means for scanning with the light beam;

an image bearing means for bearing a plurality of images formed with a plurality of light intensities of the light emitting means and a plurality of image area rates, respectively, transferred from a photoconductor;

an image density detecting means for detecting a plurality of image densities of the plurality of images at a plurality of positions on at least one of the image bearing means and the photoconductor, respectively, in a main scanning direction of the light beam;

an image processing means for calculating an image area rate of a target image to be formed based on inputted image data and determining a light intensity correction value to correct an image density of the target image in the main scanning direction based on the plurality of light intensities of the plurality of images, the plurality of image area rates of the plurality of images, the plurality of image densities detected by the image density detecting means, the plurality positions at which the image density detecting means detects the plurality of image densities, and the image area rate of the target image, and outputting a control signal to adjust a light intensity of the light beam emitted by the light emitting means; and a light intensity adjusting means for adjusting the light intensity of the light beam emitted by the light emitting means based on the control signal output by the image processing means.

* * * * *